United States Patent [19]

Wessling

[11] Patent Number: 4,929,388

[45] Date of Patent: May 29, 1990

[54] ANTISTATIC OR ELECTRICALLY SEMICONDUCTING THERMOPLASTIC POLYMER BLENDS, METHOD OF MAKING SAME AND THEIR USE

[75] Inventor: Bernhard M. Wessling, Tremsbuttel, Fed. Rep. of Germany

[73] Assignee: Zipperling Kessler & Co. (GmbH & Co.), Ahrensburg, Fed. Rep. of Germany

[21] Appl. No.: 795,250

[22] Filed: Nov. 5, 1985

[30] Foreign Application Priority Data

Nov. 7, 1984 [DE] Fed. Rep. of Germany ..... 3440617

[51] Int. Cl.[5] ..... H01B 1/06

[52] U.S. Cl. ..... 252/500; 252/503; 252/506; 252/511; 252/512; 252/518; 524/495; 524/496; 524/81; 524/439

[58] Field of Search ..... 252/511, 500, 512, 518, 252/503, 506; 524/495, 496, 439, 81, 239, 236, 401, 502, 910, 911; 525/185

[56] References Cited

U.S. PATENT DOCUMENTS 3,178,384 4/1965 Rice et al. .
3,200,056 8/1965 Bond et al. .
4,265,789 5/1981 Christopherson et al. .
4,510,076 4/1985 Lee et al. ..... 252/512
4,569,786 2/1986 Deguchi ..... 252/511
4,598,127 7/1986 Kotani et al. ..... 252/500
4,622,355 11/1986 Arnold et al. ..... 252/500

FOREIGN PATENT DOCUMENTS 2435418 6/1978 Fed. Rep. of Germany .

OTHER PUBLICATIONS

"Russ Als Pigment Fuer Kunstoffe" (Degussa 1969).
"Ketjenblack EC" (Akzo Company 1983), (Armak Company 1975).

*Primary Examiner*—Josephine Barr
*Attorney, Agent, or Firm*—Cushman, Darby & Cushman

[57] ABSTRACT

Antistatic or electrically semiconducting thermoplastic polymer blends contain two partially compatible thermoplastic polymers A and B, whereof polymer A has a lower viscosity than polymer B and whereby the solubility parameters thereof also differ. Polymer A, which forms the continuous phase, contains an addition of electrically conductive substances and forms current-carrying conductor tracks. The polymer blends are suitable for producing antistatic or electrically semiconductor coatings, foils, moulded articles or parts.

15 Claims, 4 Drawing Sheets

FIG. 5
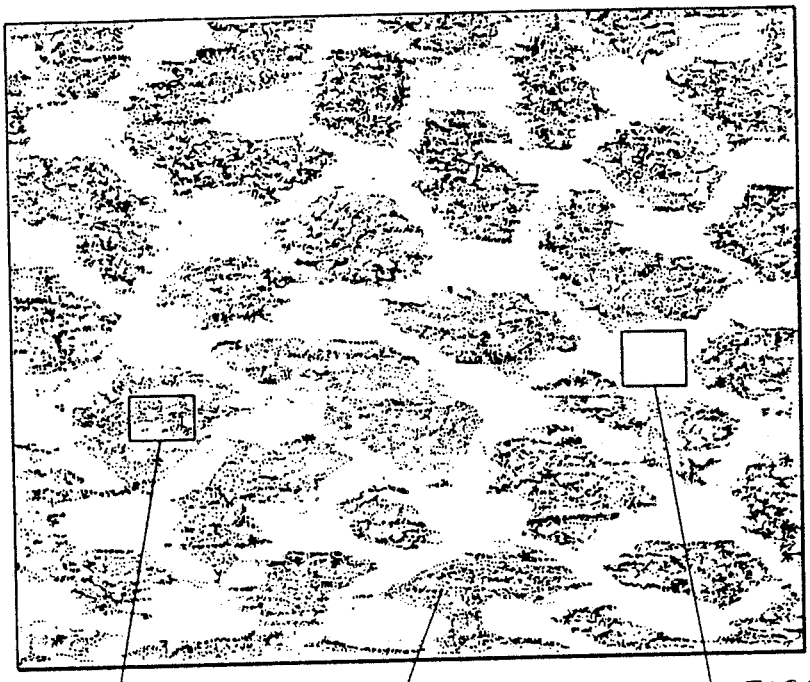
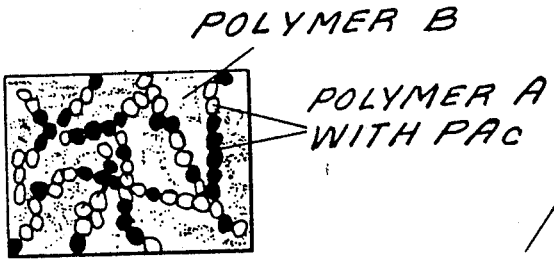
FIG. 6
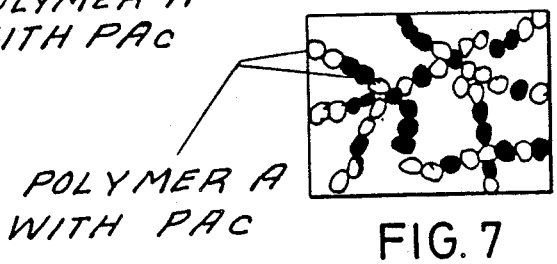
FIG. 7

ANTISTATIC OR ELECTRICALLY SEMICONDUCTING THERMOPLASTIC POLYMER BLENDS, METHOD OF MAKING SAME AND THEIR USE

It is known to add widely varying types of electrically conductive substances to thermoplastic polymers, which are in fact electrical insulators. Using mainly non-polymeric additives, such as in particular antistatics, it is possible to give an antistatic finish to statically easily chargeable polymers. In this way it is possible to reduce the surface resistance of $10^{12}$ to $10^{16}$ Ω to approximately $10^8$ to $10^{10}$ Ω (cf. German patent 33 47 704). A further reduction of the resistivity to approximately $10^1$ to $10^7$ Ωcm (semiconducting to antistatic finish) is possible with the aid of conductive additives, such as metal fibres or particles, carbon fibres, conductive carbon black and the like (cf. A. Sternfield, Modern Plastics International, no. 7, 48ff, 1982). These additives are used in quantities of approximately 10 to 30% by weight. They not only lead to an antistatic surface finish, but also to a reduction in the contact or volume resistance.

Of late it has proved possible to add electrically conductive polymers or non-polymeric organic conductors to electrically non-conductive polymers and in this way produce antistatic to semiconducting polymer blends (cf. not yet published EP-A 85107027.6).

In all these cases, the increase in the electrical conductivity from the starting value of the non-conductive polymer to a value characteristic of the conductive material is not linearly dependent on the concentration of the added substance. Instead, at the breakthrough or percolation point, there is a more or less steep rise in the conductivity, which is due to the fact that the particles of the conductive material come sufficiently close to one another or are in contact and consequently form continuous current paths or conductor tracks. The breakthrough point is very highly dependent on the geometry, particularly the length to diameter ratio, as well as the surface area of the added particles, the nature of the polymer and the dispersion method used. The percolation point is the inflection point of the curve, when the conductivity logarithm is plotted against the conductive additive concentration.

It has not hitherto been possible to theoretically accurately describe and in particular forecast the conductivity breakthrough (percolation). K. Miyasaka et al (J. Mat. Sci., vol. 17, pp. 1610–1616, 1982) have worked out a theory based on the interfacial tension, which is very helpful for qualitative considerations. However, in practice, much higher proportions of conductive additives than theoretically established by Miyasaka are required. This is probably due to the fact that when incorporating the additives into the polymer and further processing the polymer blends to end products, conductivity bridges are broken. In principle, the conductiveadditive can pass through three phases: from the undispersed agglomerate (max. cohesion contacts) via a chain structure (equilibrium between cohesion and adhesion) to the fully dispersed phase (max. adhesion).

The incorporation of high proportions of e.g. 10 to 30% by weight of conductive carbon black with a very large surface area requires a large amount of energy and impairs the processing characteristics (very considerable melt viscosity increase), the heating, oxidative and long-term stability, as well as the mechanical characteristics of the polymer. In addition, the increase in the content of conductive additives is accompanied by a significant rise in material costs, namely roughly 10% for every 1% increase in the proportion of conductive additives. Thus, attempts have been made to reduce the necessary additive content by modifying the surface or length:diameter ratio or by optimizing the processing method. On the other hand attempts have been made to increase the stability and improve the processability of the mechanical characteristics by polymer additives.

Thus, DE-OS 29 01 758 and DE-OS 29 01 776 describe the production of a network of conductive carbon black (through which the current flows) in a compression moulding material of polyethylene as the matrix. However, this material is only suitable for the discontinuous production of sheets in the compression moulding process, but not for the continuous processing by extrusion or other conventional processing processes for thermoplastics, because the network and consequently conductivity are then destroyed.

U.S. Pat. No. 4,265,789 (and the further publications referred to as prior art therein) describe polymer blends with a very high conductive carbon black content. DE-OS 32 08 841 and DE-OS 32 08 842 disclose the two to three-stage production of conductive carbon black-containing polyvinyl chloride blends with other polymers, particularly ethylene-vinyl acetate copolymers. The thermoplastic material must contain 15% by weight carbon black in homogeneously distributed form, the polymer constituents and the process being used for improving processability. DE-OS 25 17 358 mentions the addition of rubber for increasing the impact tensile strength, without a reduction in the carbon black proportion being achieved. The carbon black is added to a previously prepared homogeneous polymer/rubber mixture.

The authors of DE-AS 24 35 418 observed during the production of carbon black-containing polyethylene/-polyamide blends, that the carbon black is concentrated in the polyethylene phase and not in the polyamide islands. This can easily be explained by the large difference in the softening or melting ranges, as well as the incompatibility of the two polymers. In principle, the polyamide behaves in the manner of a non-melting filler, so that no compatible blend with good use characteristics is obtained. The carbon black contents necessary for adequate conductivity are very high and even exceed the contents now encountered in industry in homogeneous formulations based on one polymer or several completely compatible polymers.

In order to improve the thermal stability of polyoxymethylene, DE-AS 28 08 675 describes a process in which polyethylene mixed with conductive carbon black is added to the polyoxymethylene resin. However, this only gives surface resistances of more than $10^6$ Ω.

Hitherto no formulation and no process for the production of polymer compounds is known, in which the proportions of conductive substances for achieving clearly defined surface and/or specific resistances can be significantly reduced compared with the hitherto conventional additive quantities and possibly even into the vicinity of or below the percolation points applying to the particular compounds.

The problem of the present invention is therefore to provide antistatic or electrically semiconducting thermoplastically processable polymer blends, which have a much lower content of electrically conductive additives than has hitherto been the case, but which can still be thermoplastically processed in such a way as to largely maintain the conductivity and which have good mechanical properties. The additive quantities hitherto necessary for achieving percolation were approximately 10 to 20% by weight carbon black or approximately 30 to 50% by weight metal powder, as a function of the geometry and surface of the particles, the interfacial tension of the polymer and the temperature (cf. also Miyasaka, loc.cit., the theoretical values not hitherto having been achieved in practice).

The invention is directed to antistatic or electrically semi-conducting thermoplastic polymer blends based on organic polymers and electrically conductive substances, which are characterized in that they contain two partially compatible thermoplastic polymers A and B, whereof polymer A at a given temperature compared with polymer B has a lower melt viscosity and between which there is a solubility parameter difference of approximately 0.3 to 1.5 $(cal/cm^3)^{\frac{1}{2}}$, polymer A forming the continuous phase essentially containing the electrically conductive substances.

The bases for the solubility parameter theory and values in connection therewith are provided in:

(a) O. Olabisi et al, Polymer-Polymer Miscibility, N.Y., 1979
(b) D. Paul, S. Newman, Polymer Blends, N.Y., 1978
(c) K. Solc, Polymer Compatibility, Chur/Switzerland, 1980
(d) J. Brandrup et al., Polymer Handbook, N.Y., 1975
(e) A. Barton, Handbook of Solubility Parameters, Boca Raton, 1985

Surprisingly it is possible in this way to produce polymer blends with excellent processing and mechanical characteristics and which, even when adding less than 10 and preferably approximately 4 to 8% by weight conductive carbon black, have a conductivity which could hitherto only be achieved with a carbon black proportion of at least 10 to 15% by weight. It is clearly possible to concentrate the conductive additives on narrow though continuous conductor tracks and in this way to avoid an excessive dispersion of the conductive additive in the way in which it occurs in conventional procedures. Compared with the prior art, it is possible to obtain a much more accurate setting of the desired conductivity, particularly close to the percolation point.

The success of the invention would appear to be based on the fact that at least two polymers are used, whose solubility parameters differ by at least approximately 0.3 and by a maximum of approximately 1.5 $(cal/cm^3)^{\frac{1}{2}}$ and whose melt viscosity also differs (the melt viscosity of polymer A without the addition of conductive substances must be lower than that of polymer B, in each case measured at the same temperature). Clearly two continuous phases form, which reciprocally penetrate one another (interpenetrating networks) and whose phase boundaries have a good adhesion as a result of the partial compatibility of the polymers. Particularly suitable combinations corresponding to the conditions according to the invention are e.g. as follows:

ethylene-vinylacetate copolymer (EVA)/polyvinylchloride (PVC), ethylene-vinylacetate copolymer (EVA)/polyethylene (PE), chlorinated polyethylene (PEC)/acrylonitrile-butadine-styrene copolymer (ABS), styrene-butadiene-styrene-block copolymer (SBS)/polyethylene (PE), polystyrene (PS)/styrene-butadiene-styrene block copolymer (SBS), polyamide copolymer (PA)/polyamide (PA), polyamide (PA)/-polyoxymethylene (POM), ethylene-vinylacetate copolymer (EVA)/acrylonitrile-butadiene-styrene copolymer (ABS), α-methylstyrene/polyvinylchloride (PVC), ethylene-vinylacetate-carbonmonoxide copolymer (EVA-CO)/polyvinyl-chloride (PVC), ethylene-vinylacetate-carbonmonoxide copolymer (EVA-CO)/-polyurethane (PUR), polyurethane (PUR)/polyamide (PA), polyurethane (PUR)/polycarbonate (PC), polycaprolactone (PCL)/polyether polyurethane (PUR-ether), polyester polyurethane (PUR-ester)-/polyvinyl chloride (PVC), polyurethane (PUR)/acrylonitrile-butadiene-styrene copolymer (ABS), polycaprolactone (PCL)/acrylonitrile-methacrylate-butadiene copolymer, polycaprolactone (PCL)/polyurethane (PUR) or polycaprolactone (PCL)/ethylene-vinylacetate copolymer (EVA).

It is also possible for polymer A and/or polymer B to be mixtures of reciprocally completely compatible thermoplastic polymers. Examples of such mixtures are styrene-acrylonitrile copolymer (SAN) with chlorinated polyehtylene (PEC) and polyvinyl butyral (PVB) with polyvinyl pyrrolidone-vinylacetate copolymer (PVP-VA).

The conductive additive is substantially located in the continuous phase of the blend-forming polymer A. Polymer B is normally present in excess compared with polymer A, i.e. the weight ratio of polymer A: polymer B is $\leqq 1:1$. Preferably the proportion of polymer A in the mixtures of polymers A and B is approximately 20 to 40% by weight. To a certain extent, the quantity of polymer A is dependent on the quantity of conductive additives present, because based on the total blend the quantity of polymer A and conductive additives should preferably be below 50% by weight, e.g. 10 to 49% by weight.

The electrically conductive additive is preferably conductive carbon black with a BET-surface $> 250\ m^2/g$ and a dibutyl phthalate absorption $> 140\ cm^3/100\ g$. Carbon fibres, metal powders or fibres, electrically conductive organic polymers or non-polymeric organic conductors are also suitable. The term "conductive polymers" is understood to mean polyconjugate systems, as present in polyacetylene (PAc), poly-1,3,5. . . n-substituted polyacetylenes, acetylene copolymers, as well as 1,3-tetramethylene-bridged polymers, e.g. in polymers resulting from the polymerization of 1,6-heptadiene and similar polyacetylene derivatives. These also include the various modifications of polyparaphenylenes (PPP), the different modifications of polypyrrolene (PPy), the different modifications of polyphthalocyanins (PPhc) and other polymeric organic conductors. These can be present as such or as polymers complexed (doped) with oxidizing or reducing substances. Complexing generally leads to an increase in the electrical conductivity of several powers of 10 into the range of metal conductors. "Organic conductors" are understood to be conductive, non-polymeric organic substances, particularly complex salts or charge transfer complexes, e.g. the different modifications of tetracyanoquinodimethane (TCNQ) salts.

It is also possible to use mixtures of several of the aforementioned conductive additives. Conductive carbon black is added to the polymer blends according to the invention, preferably in a quantity of approximately 0.5 to 10, particularly 4 to 10% by weight, based on the polymer blend. For other substances, e.g. metal powders, the necessary content can in certain circumstances be higher and amount to up to 30% by weight. However, it is regularly lower than in the hitherto known products, in which the conductive additive is present in a uniformly dispersed manner in the polymer.

Surface resistance values of 10 to $10^6$ Ω are obtained.

Particular advantages are obtained when using the aforementioned intrinsically conductive polymers or non-polymeric organic conductors, because compared with all the other additives, it is possible to still further significantly reduce the proportions. The finding that conductive polymers, such as e.g. polyacetylene when using a suitable polymer A, e.g. polycaprolactone can be incorporated into virtually all polymers is very surprising. In the optical microscope, it is possible to find single-phase microstructures (with styrene/acrylonitrile copolymer, polyvinyl chloride or polycarbonate as polymer B), drop structures (with polyethylene or ethylene-vinyl acetate as polymer B) or the particularly preferred conductor tracks (with polyether polyurethane or acrylonitrile/methacrylate/butadiene copolymer as polymer B. A surface resistance of approximately $10^5$ to $10^8$ Ω is obtained even with an addition of only 1 to 3% by weight.

The polymer blends according to the invention can also contain conventional additives, such as stabilizers, pigments, lubricants, etc. According to a special embodiment of the invention, it is possible to add chemical crosslinking agents, e.g. a preferably liquid peroxide and consequently achieve a crosslinking of the polymer during the subsequent processing of the blend, accompanied by heating, so that mechanical stabilization of the conductor tracks of the present invention is obtained.

In a particularly preferred manner, the crosslinking agent is added to polymer A or the conductivity concentrate comprising polymer A and the conductive substances, in order to stabilize the conductor tracks in the matrix of polymer B. However, it is also possible to incorporate the crosslinking agent into polymer B or the polymer blend and in this way to achieve a fixing of the structures formed.

For producing the polymer blends according to the invention, it is possible to proceed in such a way that in a first step the conductive substances are dispersed in a solution or melt of polymer A or a prepolymer for polymer A, the solvent is optionally removed and then in a second step the thus prepared conductivity concentrate is melted with polymer B and polymerized using a prepolymer. When using suitable polymer combinations, it is also possible to directly disperse the conductive substances in a melt of polymers A and B. The first procedure is e.g. particularly suitable for the combination of ethylene-vinylacetate (polymer A) and polyvinyl chloride (polymer B), because when preparing a conductivity concentrate from polymer A and carbon black and subsequent melt mixing with polymer B much better results and particularly a lower carbon black content are obtained for the same electrical conductivity than with a single-step process. However, e.g. when using styrene-butadiene-styrene copolymer as polymer B and polystyrene as polymer A, it is possible to jointly melt both polymers and to incorporate the conductive substances in one step, e.g. in a Banbury mixer or a twin-screw extruder. It is also possible to combine the 1-step and 2-step processes, i.e. initially producing the mixture of polymer A and the conductivity additive and then to mix polymers A and B, accompanied by an addition of a further part of the conductivity additive.

The mechanical characteristics of the polymer blends according to the invention are excellent and they in particular have a very good impact strength without break.

Conductivity concentrates containing polymer A and a conductive substance are used in the aforementioned production process. The conductivity concentrate can contain more than 15 and preferably approximately 20% by weight of conductive carbon black, more than 50% by weight metal powder, or more than 10 and preferably approximately 15% by weight of an organic conductive polymer or a non-polymeric organic conductor. Preferably these conductivity concentrates are added directly to polymer B during the production of the end products.

As mentioned hereinbefore, in certain circumstances it can be desirable to crosslink the polymer for stabilizing the structure. When adding chemical crosslinking agents to the polymer blend, this can take place by heating during the production of the blend or during its processing. It is also possible to carry out crosslinking in a manner known per se by irradiation.

It can be advantageous in certain cases to allow chemical reactions to take place during or immediately following the incorporation of the conductive substances, in order to further improve the use characteristics of the conductive blends or the finished parts produced therefrom. For example, in a manner known per se (J. Gabbert, Preprints of Third Int. Conf. on Reactive Processing of Polymers, Strasburg, 5 to 7.9.1984, p.137, J. van der Loos, loc.cit., p.149) conductive substances, such as conductive carbon black can be incorporated into an ambient temperature-liquid prepolymer of formula $$OCN-R\left(O-CH_2\overset{\overset{CH_3}{|}}{C}H\right)_n O-R-NCO,$$

in which R is a divalent hydrocarbon radical and n=50 to 5000 and to mix same in per se known manner with caprolactam (as polymer B) and a catalyst. On extruding the mixture, a conductive, thermoplastically processable block copolymer is obtained, in which the blocks derived from the prepolymer form a continuous conductor track in the matrix. In this way, specific conductivity values of $10^2$ to $10^4$ Ωcm are obtained with a prepolymer content of 10 to 20% by weight and a carbon black content in the prepolymer of approximately 20%, corresponding to a carbon black content in the blend of 2 to 4% by weight.

Advantageously the polypropylene oxide chain is replaced by polycaprolactone and from it another prepolymer is produced if e.g. in place of conductive carbon black, polyacetylene is to be incorporated as the conductive substance.

In certain cases, a chemical reaction can take place between polymers A and B for producing the partial compatibility necessary according to the invention. At the interfaces between phases A and B, copolymers of A and B form. This can e.g. take place by catalysed or uncatalysed addition, esterification, transesterification, saponification, transamidation or elimination reactions and the like. The prerequisite is that non-reactive polymers (such as polyolefins or polystyrene) have been functionalized beforehand in per se known manner (e.g.

with maleic anhydride) or that reactive groups are used (e.g. polymers containing hydroxyl groups or esters). Suitable polymer blends are e.g.:

maleic anhydride-modified ethylene-propylene-diene terpolymer/polyamide,
maleic anhydride-modified polyethylene/polyamide,
maleic anhydride-modified polyethylene/polystyrene,
maleic anhydride-modified polystyrene/polyethylene,
polycaprolactone/maleic anhydride-modified polyethylene,
polycaprolactone/maleic anhydride-modified ethylene-propylene-diene terpolymer,
polycaprolactone/maleic anhydride-modified polystyrene,
polyvinylalcohol/ethylene-vinylacetate copolymer,
cellulose propionate/ethylene-vinylacetate copolymer,
cellulose propionate/polyethylene terephthalate,
cellulose propionate/polycarbonate,
ethylene-vinylacetate copolymer/polyethylene terephthalate,
ethylene-vinylacetate copolymer/polycarbonate.

The desired coupling reaction must optionally be catalysed, e.g. transesterification or transamidation reactions with p-toluene sulphonic acid.

It is possible in the aforementioned manner to render partially compatible polymer pairs which are actually incompatible and which would not in fact form conductor tracks by the process according to the invention. This is particularly noteworthy with the polymer pairs polyethylene/polyamide or ethylene-propylene-diene terpolymer/polyamide. As a function of the viscosity conditions, without compatibilizing reactions carbon black-containing or carbon black-free, drop-like occluded phases are obtained, whereas conductor tracks are obtained following the aforementioned compatibilization. For this purpose maleic anhydride and a peroxide are added to EPDM or polyethylene, allowed to react in the melt, followed by the addition of carbon black. The optionally granulated mixture is then processed together with a polyamide.

Even in the case of already partially compatible polymer pairs according to the invention, the in situ production of copolymers can be advantageous for stabilizing the interfaces. In European patent application 85107027.6 a description is given of the crystallization of N-methylquinoline-TCNQ dissolved in polycaprolactone. It is possible with the present invention to incorporate into ethylene-vinylacetate copolymers a mixture containing e.g. 1 to 3% by weight of TCNQ in polycaprolactone, which leads to the formation of networks. On crystallizing out the TCNQ salt, the phases partly separate again, because the mixture must be kept thermoplastic for a long time without shearing and under these conditions the compatibility is not adequate for maintaining the microscopically fine network structure. By catalytic transesterification, the addition of p-toluene sulphonic acid stabilizes the interfaces.

The polymer blend according to the invention can optionally be initially granulated and supplied to the further processor in granule form. They can also be directly processed to the finished products. The blends are particularly suitable for producing antistatic, electrically conductive coatings, foils, moulded articles or parts.

If the foils or mouldings produced from the polymer blends are mechanically stretched, this leads to an orientation of the conductor tracks, so that the stretched materials have a preferred current direction, which is particularly advantageous for various applications.

The following examples serve to illustrate the invention in a non-limitative manner.

EXAMPLE 1

75% by weight of polystyrene, 15% by weight of a styrene-butadiene-styrene radial block copolymer, 3.5% by weight of conventional stabilizers and processing aids and 6.5% by weight of conductive carbon black (Akzo Ketjenblack EC) were successively added to a closed mixer and mixed for 4 to 5 minutes at approximately 180° C. (the mixer filling volume was 25 litres). The polymer blend formed was then granulated. After pressing to a sheet, the material had a surface resistance (measured with an annular electrode according to DIN 53482) of 0.1 to $2.10^3$ Ω. By extrusion, it was possible to produce from the granules deep-drawable sheets having a surface resistance of 0.5 to $5.10^4$ Ω. The sheets had an impact strength without break (DIN 53453) and a notch impact strength of 14 mJ/mm$^2$.

EXAMPLE 2

As in example 1, 79% by weight of ethylene-vinylacetate copolymer (with a 7% vinylacetate content), as well as conventional stabilizers and processing aids were added to 20% by weight conductive carbon black and mixed together at 170° C. The resulting conductivity concentrate (resistivity according to the four-point method approximately 5 Ωcm) was granulated in a second operation with stabilized polyvinyl chloride granules (K-value 67 or 70) or directly extruded to a finished product (e.g. a sheet), the temperature of the mixture being approximately 185° to 190° C. The resulting semiconducting polymer blend or the finished sheet had an impact strength without break, as well as the electrical characteristics given in the following table 1.

EXAMPLE 3

In the same way conductivity concentrates were obtained using styrene-butadiene-styrene copolymer, chlorinated polyethylene, styrene-acrylonitrile copolymer, polyamide-6,12 and polycaprolactone. After extruding with polymer B, the results obtained in the following table were achieved.

TABLE 1

| Polymer A | Polymer B | Ratio of polymer A with 20% carbon black:polymer B | Final carbon black content (% by weight) | Stock temperature (°C.) | Surface resistance Ω |
|---|---|---|---|---|---|
| SBS | PE | 1:1 | 10 | 170 | $8 \times 10^3$ |
| " | " | 3:7 | 6 | 170 | $8 \times 10^3$ |
| " | " | 1:4 | 4 | 170 | approx. $10^9$ |
| " | pp | 1:1 | 10 | 190 | $2 \times 10^3$ |
| CPE/SAN | PVC (K67) | 1:1 | 10 | 185 | $4 \times 10^2$ |

TABLE 1-continued

| Polymer A | Polymer B | Ratio of polymer A with 20% carbon black:polymer B | Final carbon black content (% by weight) | Stock temperature (°C.) | Surface resistance Ω |
|---|---|---|---|---|---|
| " | " | 3:7 | 6 | 185 | $2 \times 10^6$ |
| " | " | 1:4 | 4 | 185 | approx. $10^{10}$ |
| " | ABS | 1:1 | 10 | 210 | $5 \times 10^2$ |
| " | " | 3:7 | 6 | 210 | $6 \times 10^3$ |
| " | " | 1:4 | 4 | 210 | $8 \times 10^5$ |
| PUR | ABS | 3:7 | 6 | 230 | $2 \times 10^4$ |
| EVA | PVC (K67) | 1:1 | 10 | 190 | $5 \times 10^1$ |
| " | " | 3:7 | 6 | 190 | $4 \times 10^3$ |
| " | " | 1:4 | 4 | 190 | $6 \times 10^6$ |
| " | PVC (K70) | 1:1 | 10 | 195 | $2 \times 10^1$ |
| " | " | 3:7 | 6 | 195 | $6 \times 10^2$ |
| " | " | 1:4 | 4 | 195 | approx. $10^{10}$ |
| PA-6,12 | PA-6 | 1:1 | 10 | 235 | $5 \times 10^3$ |
| " | POM | 3:7 | 6 | 220 | $4 \times 10^4$ |

The results show that the sought surface resistance of $< 10^6$ Ω with different polymer combinations is already achieved with a carbon black content of 4% by weight. When using carbon black contents between 6 and 10% by weight, surface resistance values are obtained, which were hitherto unachievable or could only be achieved with much higher carbon black contents.

EXAMPLE 4

Using the polymer blends obtained according to examples 1 to 3, sections were produced with the aid of a microtome for optical microscopic investigation and were investigated in detail with a 1000× magnification.

It is clear that the conductive carbon black is largely located in the polystyrene phase, whereas the SBS-radial block copolymer is dispersed in the matrix, without interrupting the conductivity bridges.

EXAMPLE 5

In per se known manner (cf. the not prior published German application P 34 22 316.9) polyacetylene was mixed with polycaprolactone (molecular weight ≈ 20,000), but unlike in the aforementioned patent application, a concentrate was prepared with a polyacetylene content of 15% by weight. The faultless dispersion was checked, in that three parts of the polyacetylene-polycaprolactone concentrate were mixed with 100 parts of polycaprolactone on a roller mill and pressed out thin in a laboratory press. It had a deep blue colour and no black points or dots (polyacetylene agglomerates) could be detected. The polyacetylene concentrate was extruded on a single-screw extruder to a polymer blend with polymers B referred to in the following table. Either a granular material or a finished product was produced. The product obtained can e.g. be made conductive by treatment with iodine (doped). The results given in the following table were obtained.

TABLE 2

| Polymer A | Polymer B | A:B | % PAc | Surface resistance (Ω) |
|---|---|---|---|---|
| PCL | Polyether polyurethane | 6.6:93.4 | 1 | $10^5$ |
| PCL | Acrylonitrile-methacrylate-butadiene copolymer | 5:95 | 1 | $10^8$ |

Once again microtome sections were produced from the above polymer blends and investigated in optical microscopic manner with a 1000× magnification.

Figure 1:
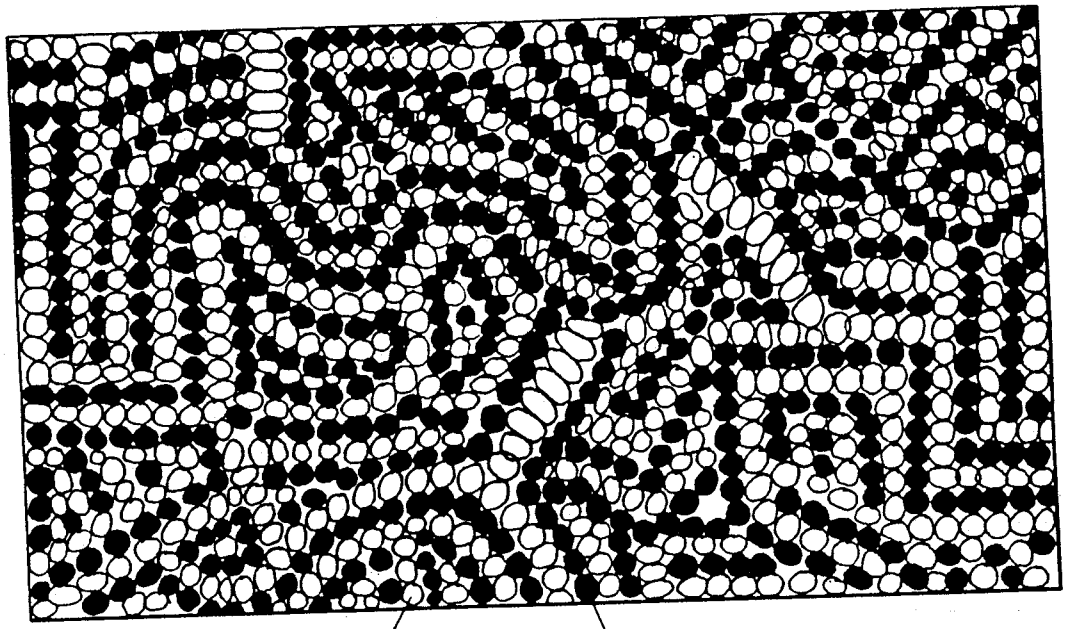
FIG. 1 is the image obtained with a polymer blend of PEC/SAN and ABS in a ratio of 3:7. It is clearly possible to see the conductor tracks of carbon black-containing polymer A in the matrix of polymer B.
Figure 2:
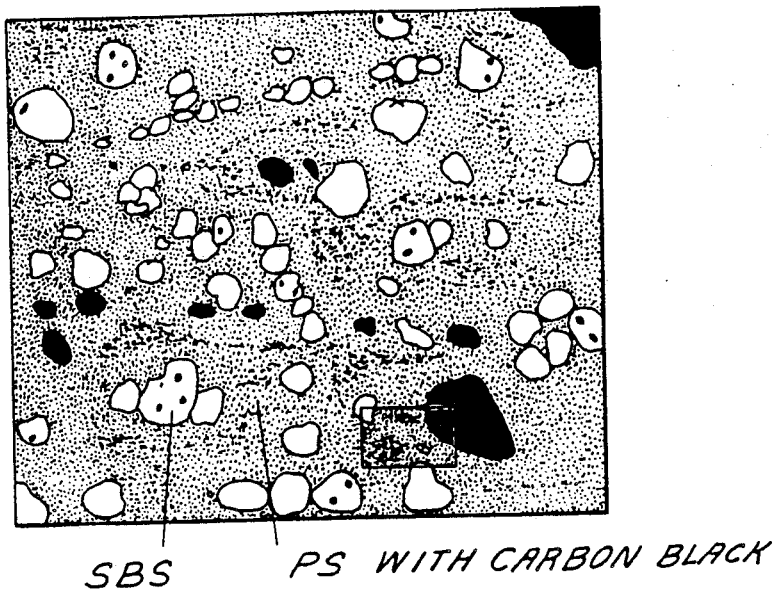
FIG. 2 shows the polymer blend of example 1.
Figure 3:
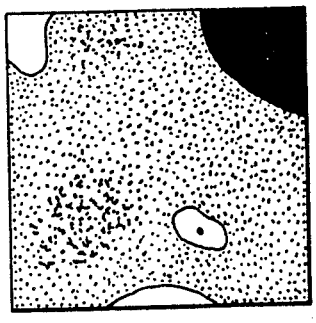
FIG. 3 is a detail of FIG. 2.
Figure 4:
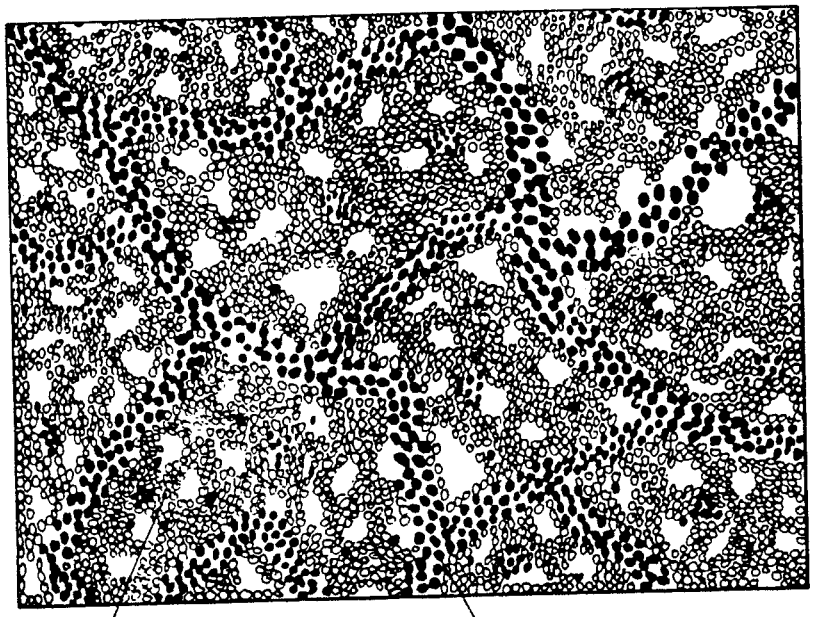

FIG. 4 is the image obtained for conductor tracks from polyacetylene/polycaprolactone in polyether polyurethane as the matrix (polymer B).

FIG. 5 is a section through a polymer blend of the same type, but with acrylonitrile-methacrylate-butadiene copolymer as the matrix or polymer B.

FIGS. 6 and 7 are larger-scale details of FIG. 4, in which it is possible to clearly see the conductor tracks. However, they are not located in a single plane and instead form a three-dimensional network. However, due to the limited depth of field of the microscope, not all the particles of the conductivity concentrate are sharply imaged. The unfilled circles represent these not sharply imaged particles.

EXAMPLE 6

A mixture of 1.2% TCNQ complex in PCL was mixed in a closed mixer with the same quantity of EVA (30% VA) at 130°-160° C. The stock obtained was pressed out to form a foil, which was pressed for 30 seconds at 190° C. during which the TCNQ complex decomposed. The foil was then immediately tempered for 10 minutes in water at 95° C. and then quenched in water at 15° C. During tempering at 95° C., cluster-like, very long TCNQ complex crystal needles formed. The foil had a surface resistance of $3 \times 10^8$ Ω (without TCNQ:approx. $10^{12}$ Ω).

I claim:

1. Antistatic or electrically semiconducting thermoplastic polymer blends based on organic polymers and electrically conductive substances, said polymer blends containing two partially compatible thermoplastic polymers A and B, wherein polymer A at a given temperature has a lower melt viscosity than polymer B, wherein there is a solubility parameter difference between polymer A and polymer B of approximately 0.3 to 1.5 $(cal/cm^3)^{\frac{1}{2}}$, wherein the weight ratio of polymer A:- polymer B is≦1:1, wherein polymer A forms the continuous phase essentially containing the electrically conductive substances, wherein said polymer blends contain conductive substances in a quantity of 0.5 to 30% by weight, based on the polymer blend, and said conductive substances are selected from the group consisting of metal powders or fibers, carbon fibers, conductive carbon black with a BET-surface>250 $m^2/g$ and a dibutyl phthalate absorption>140 $cm^3/100$ g, electrically conductive doped organic polymers, non-polymeric organic conductors, and mixtures thereof.

2. Polymer blends according to claim 1, wherein polymers A and B are selected from the group consisting of ethylene-vinylacetate copolymer/polyvinylchloride, ethylene-vinylacetate copolymer/polyethylene, chlorinated polyethylene/acrylonitrile-butadiene-styrene copolymer, styrene-butadiene-styrene-block copolymer/polyethylene, polystyrene/styrene-butadiene-styrene block copolymer, polyamide copolymer/-polyamide, polyamide/polyoxymethylene, ethylene-vinylacetate copolymer/acrylonitrile-butadiene-styrene copolymer, α-methylstyrene/polyvinylchloride, ethylene-vinylacetate-carbonmonoxide copolymer/-polyvinylchloride, ethylene-vinylacetate-carbonmonoxide copolymer/polyurethane, polyurethane/-polyamide, polyurethane/polycarbonate, polycaprolactone/polyether polyurethane, polyester polyurethane/-polyvinyl chloride, polyurethane/acrylonitrile-butadiene-styrene copolymer, polycaprolactone/acrylonitrile-methacrylate-butadiene copolymer, polycaprolactone/polyurethane and polycaprolactone/ethylene-vinylacetate copolymer and mixtures thereof.

3. Polymer blends according to claim 1 wherein polymer A is a mixture of mutually compatible thermoplastic polymers.

4. Polymer blends according to claim 1 wherein polymer B is a mixture of mutually compatible thermoplastic polymers.

5. Polymer blends according to claim 1, wherein the the proportion of polymer A in the mixture of polymers A and B is 20% to 40% by weight.

6. Polymer blends according to claim 1, wherein said polymer blends contain chemical crosslinking agents for one or more of said polymers.

7. Polymer blends according to claim 1, wherein the conductive substance is a conductive organic polymer selected from the group consisting of polyacetylene; poly (1,3,5. . . n-substituted polyacetylene); acetylene copolymers; 1,3-tetramethylene bridged polymers; poly(1,6-heptadiene); polyparaphenylenes; polypyrrolene; and polyphthalocyanins.

8. Polymer blends according to claim 1, wherein the conductive substance is a non-polymeric organic conductor selected from the group consisting of complex salts and charge transfer complexes.

9. Polymer blends according to claim 1, wherein the conductive substance is a tetracyanoquinodimethane salt.

10. Polymer blends according to claim 1, wherein the conductive substance is carbon black, and said carbon black is present in a quantity of 0.5 to 10%, by weight based on the polymer blend.

11. Polymer blends according to claim 1, wherein the conductive substance is metal powders, and said metal powders are present in a quantity of less than 30%, by weight based on the polymer blend.

12. Polymer blends according to claim 1, wherein the conductive substance is polyacetylene, and said polyacetylene is present in a quantity of 1 to 3%, by weight based on the polymer blend.

13. Antistatic or electrically semiconducting thermoplastic polymer blends based on organic polymers and electrically conductive substances, said polymer blends containing two partially compatible thermoplastic polymers A and B, wherein polymer A at a given temperature has a lower melt viscosity than polymer B, wherein there is a solubility parameter difference between polymer A and polymer B of approximately 0.3 to 1.5 $(cal/cm^3)^{\frac{1}{2}}$, wherein the weight ratio of polymer A:-polymer B is≦1:1, wherein polymer A forms the continuous phase essentially containing the electrically conductive substances, wherein said polymer blends contain conductive substances in a quantity of 0.5 to 30% by weight, based on the polymer blend, and said conductive substances are selected from the group consisting of metal powders or fibers, carbon fibers, conductive carbon black with a BET-surface>140 $cm^3/100$ g, and mixtures thereof.

14. Antistatic or electrically semiconducting thermoplastic polymer blends based on organic polymers and electrically conductive substances, said polymer blends containing two partially compatible thermoplastic polymers A and B, wherein polymer A at a given temperature has a lower melt viscosity than polymer B, wherein there is a solubility parameter difference between polymer A and polymer B of approximately 0.3 to 1.5 $(cal/cm^3)^{\frac{1}{2}}$, wherein the weight ratio of polymer A:-polymer B is≦1:1, wherein polymer A forms the continuous phase essentially containing the electrically conductive substances, wherein said polymer blends contain conductive substances in a quantity of 0.5 to 30% by weight, based on the polymer blend, and said conductive substances are selected from the group consisting of electrically conductive doped organic polymers, non-polymeric organic conductors and mixtures thereof.

15. An article having an antistatic or electrically conductive coating and foil or moulded article comprised of a polymer blend having the composition of claim 1.

* * * * *